US006349185B1

(12) United States Patent
Burkes et al.

(10) Patent No.: US 6,349,185 B1
(45) Date of Patent: Feb. 19, 2002

(54) METHODS AND APPARATUS FOR CALIBRATING INLINE COLOR LASER PRINTERS

(75) Inventors: Theresa A. Burkes, Meridian; George B. Clifton, Boise, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/652,608

(22) Filed: Aug. 30, 2000

(51) Int. Cl.[7] ..... G03G 15/00
(52) U.S. Cl. ..... 399/49; 399/72
(58) Field of Search ..... 399/49, 15, 18, 399/60, 43, 72

(56) References Cited

U.S. PATENT DOCUMENTS

| | | | | |
|---|---|---|---|---|
| 5,452,112 A | | 9/1995 | Wan et al. | 358/504 |
| 5,760,913 A | | 6/1998 | Falk | 358/298 |
| 5,809,366 A | | 9/1998 | Yamakawa et al. | 399/39 |
| 5,995,714 A | | 11/1999 | Hadley et al. | 395/109 |
| 6,016,207 A | | 1/2000 | Wield | 358/406 |
| 6,188,418 B1 | * | 2/2001 | Hata | 399/49 X |

* cited by examiner

*Primary Examiner*—Quana M. Grainger

(57) ABSTRACT

Methods and apparatus for reducing the time required to generate a plurality of calibration image products on a transfer medium in an inline imaging device. In the method, the image producing device has a transfer medium and a developer section configured to deposit toner onto the transfer medium to thereby generate the calibration image products. One method includes depositing toner onto the transfer medium using the developer section to produce a first calibration image product. Thereafter, toner is deposited onto the transfer medium to produce at least a portion of a second calibration image product. The portion of the second calibration image is produced prior to removing the entire first calibration image product from the transfer medium. An apparatus includes a scanning section, a developer section, a transfer medium and a calibration image product generator. The calibration image generator is configured to generate a first calibration image product by causing the developer section to selectively deposit toner onto the transfer medium at a first location. The calibration image generator is further configured to generate at least a portion of a second calibration image product by causing the developer section to selectively deposit toner onto the transfer medium at a second location.

17 Claims, 6 Drawing Sheets

METHODS AND APPARATUS FOR CALIBRATING INLINE COLOR LASER PRINTERS

FIELD OF THE INVENTION

This invention pertains to inline color laser imaging devices, as well as electophotographic development processes, and in particular to methods and apparatus for reducing calibration time in an inline color imaging device.

BACKGROUND OF THE INVENTION

Color printing by an electrophotographic printer is achieved by scanning a digitized image onto a photoconductor. Typically, the scanning is performed with diodes which pulse a beam of energy onto the photoconductor. The diodes can be for example laser diodes or light emitting diodes (LEDs). The photoconductor typically comprises a drum or a belt coated with a photoconductive material capable of retaining localized electrical charges. Each localized area capable of receiving a charge corresponds to a pixel. Each pixel is charged to a base electrical charge, and then is either exposed or not exposed by the laser, as dictated by the digital data used to pulse the laser. Exposing a pixel corresponds to electrically altering (typically discharging) the localized area from the base electrical charge to a different electrical charge. One charge will attract toner, and the other charge will not. In this manner, toner is selectively transferred to the photoconductor. In most electrophotographic printing processes, the exposed (electrically discharged) pixels attract toner onto the photoconductor. This process is known as discharge area development (DAD). However, in some electrophotographic printing processes the toner is attracted to the un-discharged (i.e., charged) area on the photoconductor. This latter type of electrophotographic printing is known as charge-area-development (CAD). For purposes of discussion, it will be assumed that DAD is used, although the present invention is not limited to DAD.

Once the photoconductor has had the desired toner transferred to it, the toner is then transferred to the finished product medium. This transfer can direct, or it can be indirect using an intermediate transfer device. The finished product medium typically comprises a sheet of paper, but can also comprise a transparency. After the toner is transferred to the finished product medium, it is processed to fix the toner to the medium. This last step is normally accomplished by thermally heating the toner to fuse it to the medium, or applying pressure to the toner on the medium. Any residual toner on the photoconductor and/or the intermediate transfer device is removed by a cleaning station, which can comprise either or both mechanical and electrical means for removing the residual toner.

There are a variety of known methods for selectively attracting toner to a photoconductor. Generally, each toner has a known electrical potential affinity. Selected areas of the photoconductor are exposed from a base potential to the potential for the selected toner, and then the photoconductor is exposed to the toner so that the toner is attracted to the selectively exposed areas. This latter step is known as developing the photoconductor. In some processes, after the photoconductor is developed by a first toner, the photoconductor is then recharged to the base potential and subsequently exposed and developed by a second toner. In other processes, the photoconductor is not recharged to the base potential after being exposed and developed by a selected toner. In yet another process, the photoconductor is exposed and developed by a plurality of toners, then recharged, and then exposed and developed by another toner. In certain processes, individual photoconductors are individually developed with a dedicated color, and then the toner is transferred from the various photoconductors to a transfer medium which then transfers the toner to the finished product medium. The selection of the charge-expose-develop process depends on a number of variables, such as the type of toner used and the ultimate quality of the image desired.

Image data for an electrophotographic printer (which will also be known herein as a"laser printer"), including color laser printers, is digital data which is stored in computer memory. The data is stored in a matrix or "raster" which identifies the location and color of each pixel which comprises the overall image. The raster image data can be obtained by scanning an original analog document and digitizing the image into raster data, or by reading an already digitized image file. The former method is more common to photocopiers, while the latter method is more common to printing computer files using a printer. Accordingly, the technology to which the invention described below is applicable to either photocopiers or printers. Recent technology has removed this distinction, such that a single printing apparatus can be used either as a copier, a printer for computer files, or a facsimile machine. In any event, the image to be printed onto tangible media is stored as a digital image file. The digital image data is then used to pulse the beam of a laser in the manner described above so that the image can be reproduced by the electrophotographic printing apparatus. Accordingly, the expression "printer" should not be considered as limiting to a device for printing a file from a computer, but should also include a photocopier capable of printing a digitized image, regardless of the source of the image.

The raster image data file is essentially organized into a two dimensional matrix. The image is digitized into a number of lines. Each line comprises a number of discrete dots or pixels across the line. Each pixel is assigned a binary value relating information pertaining to its color and potentially other attributes, such as density. The combination of lines and pixels makes up the resultant image. The digital image is stored in computer readable memory as a raster image. That is, the image is cataloged by line, and each line is cataloged by each pixel in the line. A computer processor reads the raster image data line by line, and actuates the laser to selectively expose a pixel based on the presence or absence of coloration, and the degree of coloration for the pixel.

The method of transferring the digital raster data to the photoconductor via a laser, lasers or LEDs is known as the image scanning process or the scanning process. The scanning process is performed by a scanning portion or scanning section of the electrophotographic printer. The process of attracting toner to the photoconductor is known as the developing process. The developing process is accomplished by the developer section of the printer. Image quality is dependent on both of these processes. Image quality is thus dependent on both the scanning section of the printer, which transfers the raster data image to the photoconductor, as well as the developer section of the printer, which manages the transfer of the toner to the photoconductor.

A typical in-line color laser printer utilizes a plurality of (typically 4) laser scanners to generate a latent electrostatic image for each color plane to be printed. This allows for four colors to be imaged on a transfer medium and then transferred to the finished product medium. The four color planes typically printed, and which are generally considered as necessary to generate a relatively complete palate of colors, are yellow, magenta, cyan and black. That is, the color printer is typically provided with toners in each of these four colors. These colors will be known herein as the "primary colors". Some printers have the capability of printing one base color on top of another on the same pixel, so as to generate a fuller palate of finished colors. One method to accomplish this is to provide four photoconductors, one for each primary color, used in conjunction with an intermediate transfer belt. This configuration is described more fully below with respect to the prior art apparatus shown in FIG. 1.

In the scanning process, a laser is scanned from one side of the photoconductor to the opposing side and is selectively actuated or not actuated on a pixel-by-pixel basis to scan a line of the image onto the photoconductor. The photoconductor advances and the next line of the image is scanned by the laser onto the photoconductor. The side-to-side scanning by each laser is traditionally accomplished using a dedicated multi-faceted rotating polygonal mirror which causes the laser beam to be scanned across the photoconductor at the unique relative lineal position from a first edge to a second edge of the photoconductor. As the mirror rotates to an edge of the polygon between facets, the laser is essentially reset to the first side of the photoconductor to begin scanning a new line onto the advancing photoconductor.

For color printing, it is important to assure the registration of the different colors. That is, each laser should be aligned with respect to the other lasers such that a given pixel in the raster image is associated with a single common point on the photoconductor and the transfer medium, regardless of which laser is used to identify the point. A registration which is "off" will result in a blurry image, or an image with colors not representative of the raster image. Registration is thus dependent on aligning all of the lasers in a laser printer with respect to one another, a process known as calibration. Each laser and its associated components (i.e., rotating mirror, optical elements, and deflector mirror) is typically mounted in a precision housing to keep the components in relative fixed position with respect to one another. Assuring registration of the lasers requires aligning the four housings within the printer itself. As environmental conditions within the printer change (e.g., temperature), this alignment can change. Mechanical vibration or shock to the printer can also allow the lasers to become misaligned.

Since only partial calibration of the laser beams with respect to one another can be achieve by aligning the housings which contain the scanning assemblies, in-line color printers are typically also provided with a calibration system to allow for factory and ex-factory calibration of the lasers. One component of the calibration system is color plane sensors to sense color plane alignment. Sensors are provided to detect shifts in color planes in both the side-to-side scanning direction (the "scan" direction), as well as in the direction of advance of the transfer medium (i.e., the "process" direction). The sensors can provide a feedback to the scanning system and corrections can be made to reposition the laser beam using various known electrical and mechanical components and methods.

In addition to color plane alignment, color density is another criteria to which a color imaging device can be calibrated. That is, to faithfully reproduce an original image, the density of the toners as applied to the photoconductor should be applied in a manner such that the brightness, contrast and gamma (color density) of the colors appear the same in the generated image as they appear in the original image. This can be achieved by one or more of the processes of varying the quantity of toner applied to the photoconductors, by varying the combination of toners, or by varying the pixel spacing of the toner or toners as they are applied to the photoconductor.

In addition to color registration and density, another characteristic that can be important to achieving a high quality resultant image is faithful reproduction of the spectrum of the colors which are in the original image. That is, a color characterized by a given wavelength in the original image should preferably be reproduced to essentially the same wavelength in the finished image. Since the toners themselves can affect the spectral aspects of the finished product, it is desirable to provide a mechanism to compensate for toner variations, as well as other variables within the imaging apparatus which can affect spectral aspects of the final image. Such a mechanism can attempt to correct spectral variances by varying the mix of toners applied to a pixel, as well as the quantity of each toner applied.

To determine when a color density or spectrum is accurately imaged on the transfer medium, the calibration system can be further provided with color density sensors and color spectrum sensors which can detect the characteristics of a color (e.g., brightness, contract, gamma, and spectral characteristics). Preferably, the calibration sensors are configured to sense the colors deposited on the intermediate transfer medium by the photoconductors (in an inline color printer), rather than on the final printed image, since the medium on which the toner is ultimately deposited can have attributes affecting the color properties.

In order to generate an image on the transfer medium which has known properties against which a standard can be compared, most color imaging devices are provided with a calibration image of known qualities. The qualities can comprise images of known geometric patters (e.g., circles, squares, etc.), color types (e.g., a color of a known wavelength, a color of a known intensity, etc.), and color proximities (e.g., blue adjacent to red). The calibration image is typically stored in computer readable memory which is preferably resident within the imaging device itself. When calibration is to be performed, either automatically or as directed by a user, the color imaging device generates the calibration image on the intermediate transfer medium to produce a calibration product. The calibration product is then moved past the calibration sensors to detect the applied colors. The sensors send output signals to a processing unit (preferably resident within the imaging apparatus). The output signals from the calibration sensors can be stored temporarily in computer resident memory. The output signals are then compared to the calibration image on a selected pixel-by-pixel basis to determine if the calibration product varies from the calibration image, and if so, by how much.

The processor can be further provided with an algorithm to determine what correction(s), if any, need to be made to bring the calibration product into conformance with the calibration image. The corrections can include for example adjusting timing of the activation of the lasers to affect the relative positions of the application of one toner with respect to another, adjusting the intensity of the lasers to affect the amount of toner deposited on a photoconductor (and hence onto the transfer medium), adjusting the positions of energy beams from the lasers directed onto the photoconductors, and adjusting the rotational speeds of the individual photoconductors. Other adjustments are also possible. After adjustments are made, it can be preferable to generate another calibration product to determine whether or not the adjustments have brought the various components of the imaging apparatus into conformance with the calibration image.

The prior art methods for generating a calibration product are configured such that a first calibration image product is generated on the photoconductor, the first calibration product is sensed by the calibration sensors, and then the first calibration image is removed from the photoconductor by a cleaning station. Thereafter, a second calibration image product is generated on the photoconductor. The second calibration product can be either to verify that a correct calibration of the first calibration image has been performed, or to generate calibration image products having criteria different than the first calibration image product. Tertiary and subsequent calibration products can also be generated before the calibration process is complete. Once the calibration process is complete, the final calibration image product must be removed from the photoconductor before the printer is available to perform user-defined print jobs. It is thus obvious that the overall calibration time includes the time between the generation of the first calibration image product, and the time until the final calibration image product is removed from the photoconductor. It is therefore desirable to find a way to reduce the calibration time for inline color imaging devices to thus improve the availability of the device to users.

FIG. 1 depicts a schematic side elevation diagram of a four laser color electrophotographic imaging apparatus ("printer") 10 which can be used to implement the prior art calibration method. The printer 10 comprises a scanning section 12 and a photoconductor section 14, also known as the developing section. The scanning section, or "exposure section" 12 comprises a plurality of lasers (not shown), typically one laser for each photoconductor station. The coherent beams of energy from each laser are directed to a dedicated photoconductor in the developing section via a rotating reflective mirror and other optical components (not shown). The photoconductor section 14 shown in FIG. 1 comprises four optical photoconductors ("OPCs") 16, 18, 20 and 22. In the configuration shown, each OPC comprises a rotating drum which subsequently transfers toner from the OPC to the transfer medium, belt 24. In an alternate embodiment, the toner can be applied directly to the transfer medium 24 without the use of the four individual OPCs. The belt 24 rotates in the direction "A" to move toner deposited on the belt past a calibration sensor 28. The belt is supported by rollers 26. In a printing mode, a sheet of finished product medium "M", for example a sheet of paper, is passed in close proximity to the belt 24. A toner transfer module 42, typically an electrostatic charge unit, transfers toner from the belt 24 to the medium "M" . The toner is then fused to the medium at the fusing station 44. Any residual toner remaining on the belt 24 is removed by the cleaning station 40 before the belt returns to the OPC section 14.

The printer 10 further comprises a processing unit 30 which controls the discharge of the lasers in the exposure section 12 to selectively expose each OPC in the exposure section 14. The selective exposure is generated in response to a digital file version of an image to be produced collectively by the four colors. The processing unit 30 is in electrical signal communication with a computer readable memory 32. The computer readable memory 32 is provided with a digital file version 34 of the calibration image, and is further provided with a calibration algorithm 36. The calibration algorithm comprises a series of steps which can be executed by the processor 30 to direct the scanning section 12 to generate the calibration image product on the transfer belt 24. The calibration algorithm can be further configured to determine, from signals received from the calibration sensor 28 via the processing unit 30, the degree to which the imaging device 10 is out of calibration, and the amount and types of adjustments which need to be made to bring the imaging device into calibration. Finally, the calibration algorithm can be configured to cause the necessary calibration adjustments to be made to the imaging device when such calibration adjustments are automated.

FIG. 2 depicts the calibration product generation method of the prior art. The printing apparatus 10 of FIG. 1 is shown in FIG. 2 in simplified form. In the prior art method, calibration image product I1 is generated onto the transfer belt 24 by the OPCs 16, 18, 20 and 22 and moved past the calibration sensor 28. The calibration product I1 is depicted as comprising four toner colors, T1 through T4, which can be applied by respective developer stations 22, 20, 18 and 16. As is apparent from FIG. 2, the generation of a second calibration image product cannot begin until the leading edge E1 of the first image I1 has passed the cleaning station 40 and returned to the first OPC 16. Further, the generation of a second calibration product does not begin until the entire first calibration product I1 has passed the sensor 28. That is, the entire first calibration product I1 is first sensed by the sensor before the calibration algorithm determines whether or not a second calibration product is needed, and if so which type of calibration image product is to be generated.

It is thus desirable to find a way to reduce the time between the sensing of the first calibration image product and the generation of a second calibration image product.

SUMMARY OF THE INVENTION

The invention includes methods and apparatus to help reduce the time required to generate a plurality of calibration image products on a transfer medium in an inline imaging device by applying at least a portion of a second calibration image product to the transfer medium while at least a portion of a prior applied calibration image product is still on the transfer belt.

In one embodiment of the present invention, a method for generating calibration image products for an image producing device is disclosed. The image producing device has a transfer medium and a developer section configured to deposit toner onto the transfer medium to thereby generate the calibration image products. The method includes a first step of depositing toner onto the transfer medium using the developer section to produce a first calibration image product. Thereafter, toner is deposited onto the transfer medium using the developer section to produce at least a portion of a second calibration image product. The portion of the second calibration image is produced prior to removing the entire first calibration image product from the transfer medium.

The method can also include providing at least one calibration sensor configured to sense the calibration image products and generate calibration information therefrom. A computer readable memory is provided, which is configured to store the calibration information generated by the at least one calibration sensor. Calibration information relating to the first and second calibration images is stored simultaneously in the computer readable memory.

An apparatus in accordance with another embodiment of the present invention includes a scanning section, a developer section, a transfer medium and a calibration image product generator. The calibration image generator is configured to generate a first calibration image product by causing the developer section to selectively deposit toner onto the transfer medium at a first location. The calibration image generator is further configured to generate at least a portion of a second calibration image product by causing the developer section to selectively deposit toner onto the transfer medium at a second location.

The apparatus can also include a processor in signal communication with the scanning section, and computer readable memory accessible by the processor. The calibration image product generator comprises a series of computer executable steps stored in the computer readable memory. The series of computer executable steps are configured to direct the processor to cause the scanning section to generate the first and second calibration image products via the developer section. The calibration image product generator can further comprise first and second digitized calibration images to be respectively reproduced as the first and second calibration image products. In this variation, the digitized calibration images are sized to allow the first calibration image product and at least a portion of the second calibration image product to reside on the transfer medium simultaneously.

These and other embodiments and variations of the present invention will now be more fully described with respect to the accompanying drawings.

DETAILED DESCRIPTION OF THE INVENTION

Figure 1:
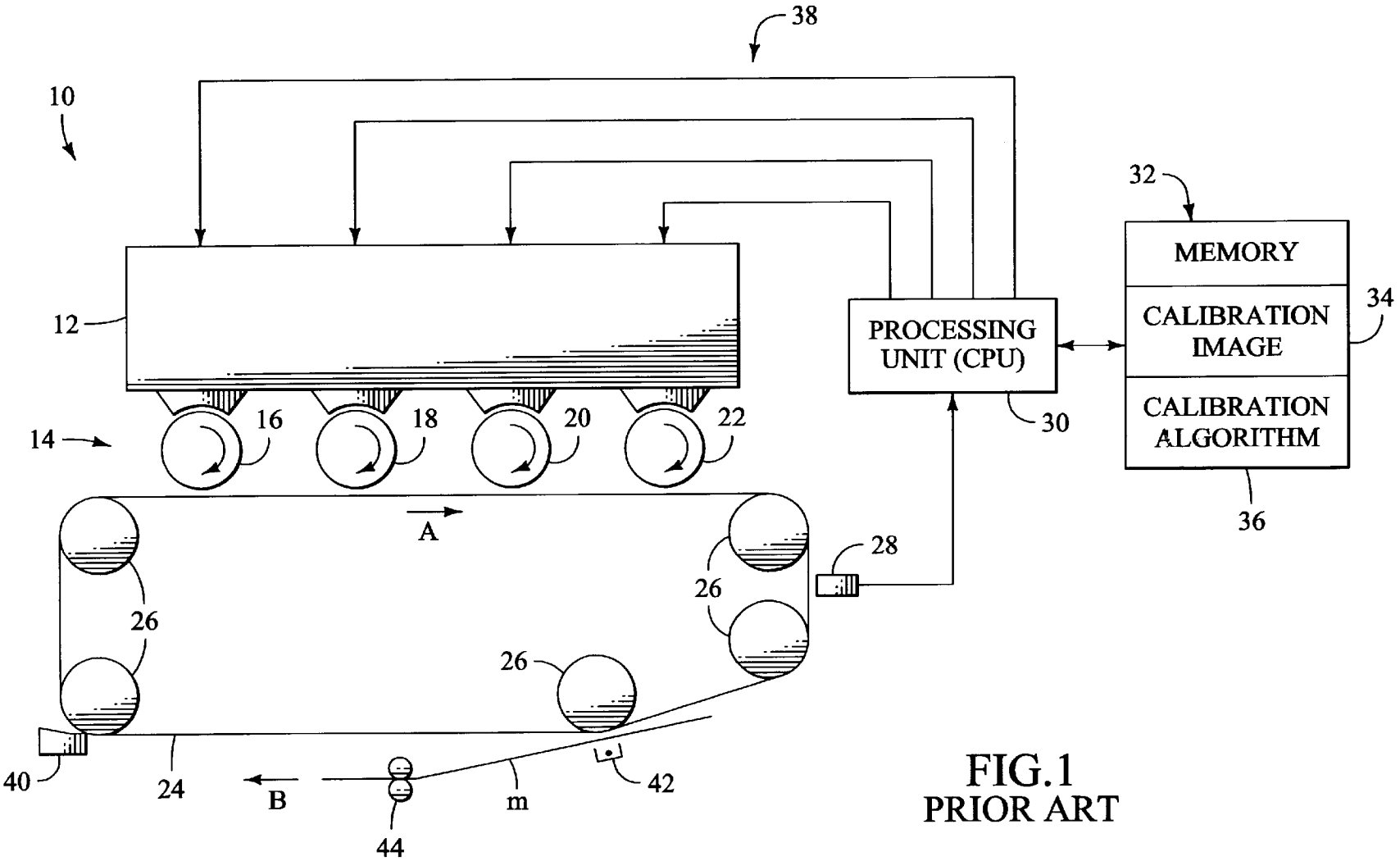
FIG.1 PRIOR ART
FIG. 1 is a side elevation schematic of a prior art imaging device having a prior art calibration image product generating algorithm.

The invention includes methods and apparatus to help reduce the time required to generate calibration image products on a transfer medium in an inline imaging device. In essence, multiple calibration images, or portions thereof, are generated onto the transfer medium to be simultaneously resident thereon.

The apparatus of the present invention is described herein as an imaging device, and particularly an inline imaging device. By "inline" we mean that a transfer medium in the imaging device is passed by a at least one, and preferably a plurality, of developer stations (or "toner stations" ) in serial order in the developer section so that toner can be applied to the transfer medium. The transfer medium can then move the toner deposited thereon to a transfer station where it can be transferred to a finished product medium, such as a sheet of paper. The transfer medium can also move the deposited toner past a calibration sensor or sensors so that the patterns of the deposition of toner on the transfer medium can be detected to determine if the deposition conforms to the desired composition, as established by a calibration image or images. One example of an inline imaging device which is within the scope of the present invention is a color laser printer. Another example is a color photocopier. However, the invention should not be considered as limited to these examples, but is understood in include all apparatus for generating an image using one or more toners.

Further, the invention is not limited to multi-toner printers (i.e., "color printers"), but can also be applied in a single-toner imaging device. A single-toner imaging device typically is provided with a black toner, and can produce half-tone images using the single toner color and the base color of the transfer medium (typically white paper) to produce images and text.

Methods for comparing a calibration image product to a calibration image are well known in the art, and will not be discussed further herein. Further, the methods and apparatus for making adjustments to an inline imaging device based on a comparison of the calibration product and the calibration image are well known in the art and need not be discussed or described further.

One embodiment of the present invention is a method for generating calibration image products for an image producing device. The image producing device has a transfer medium and a developer section configured to deposit toner onto the transfer medium to thereby generate the calibration image products. The method includes a first step of depositing toner onto the transfer medium using the developer section to produce a first calibration image product. Thereafter, toner is deposited onto the transfer medium using the developer section to produce at least a portion of a second calibration image product. The portion of the second calibration image is produced prior to removing the entire first calibration image product from the transfer medium.

In a second embodiment, the invention includes a method for calibrating an image producing device. The image producing device has a transfer medium and a developer section configured to deposit toner onto the transfer medium to thereby generate calibration image products. The image producing device further includes a calibration sensor to detect the calibration image products. In the method of the second embodiment, toner is deposited onto the transfer medium using the developer section to produce a first calibration image product. The transfer medium is moved to cause at least a portion of the first calibration image product to move towards or past the calibration sensor. Toner is further deposited onto the transfer medium using the developer section to produce at least a portion of a second calibration image product while continuing to move the first calibration image product towards or past the calibration sensor.

An apparatus in accordance with one embodiment of the present invention includes a scanning section, a developer section, a transfer medium and a calibration image product generator. The calibration image generator is configured to generate a first calibration image product by causing the developer section to selectively deposit toner onto the transfer medium at a first location. The calibration image generator is further configured to generate at least a portion of a second calibration image product by causing the developer section to selectively deposit toner onto the transfer medium at a second location.

These and other methods and apparatus in accordance with the present invention will now be more fully described.

Figure 3:
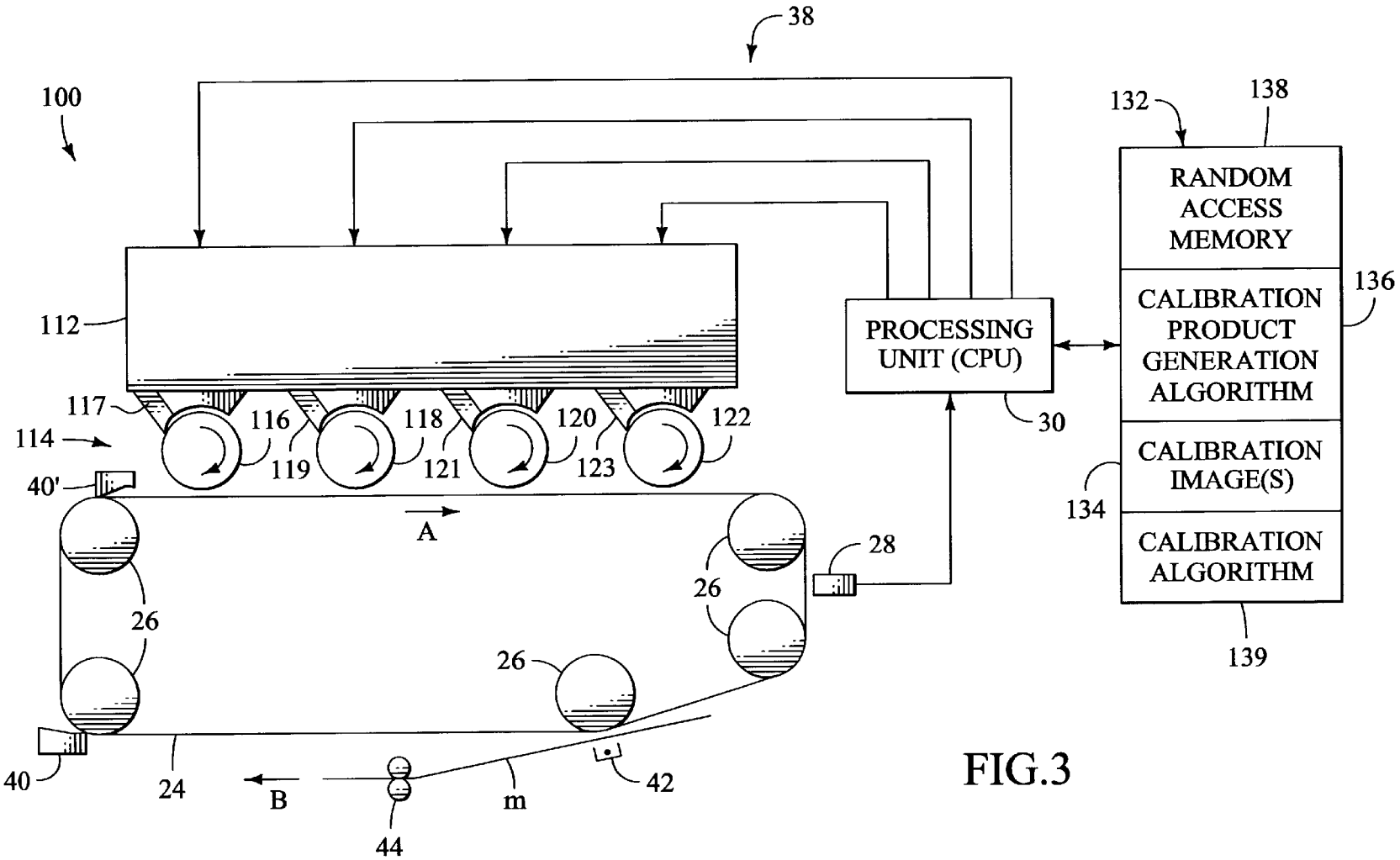
FIG. 3 is a side elevation schematic of an imaging device having a calibration image product generating algorithm in accordance with the present invention.

With reference to FIG. 3, an image producing device 100 in accordance with the present invention is shown. The operation of the apparatus 100 is similar to that described above with respect to the prior art apparatus 10. However, the apparatus 100 includes computer readable memory 132 having a calibration image or images 134 which can be different than the calibration image of the prior art, and a calibration product generation algorithm 136 which is different than the calibration product generation algorithm of the prior art. The calibration images can also be stored as calibration image components which can be assembled into a complete calibration image. The computer readable memory can further include random access memory ("RAM") 138 to temporarily store calibration information received from the calibration sensor(s). The calibration product generation algorithm 136 causes the scanner section 112 and the developer section 114, via the processing unit 30, to generate calibration image products based on the calibration images 134 in a manner in accordance with the present invention. The memory 132 can also be provided with a calibration algorithm for determining the type and amount of calibration to be performed based on signals received from the calibration sensor 28. It is understood that the processor 30 and the memory 132 can be resident within the imaging device 100, or they can be contained in a separate unit such as a remote computer. The calibration product generation algorithm 136, in conjunction with the processing unit 30, can be considered as a calibration product image generator. The scanning section 112 and the developer section 114 in combination can be considered as a calibration product image producer.

Figure 4:
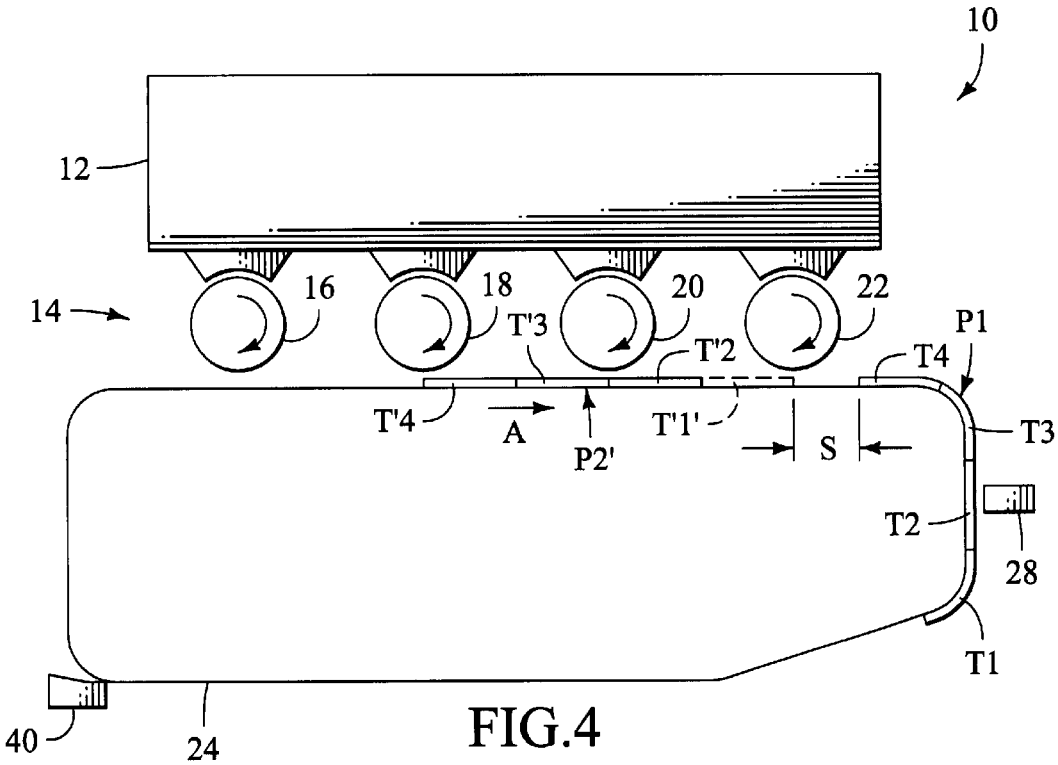
FIG. 4 is a schematic diagram depicting one method for generating a plurality of calibration image products in accordance with the present invention using the imaging device of FIG. 3.

Turning now to FIG. 4, a first embodiment of a method in accordance with the present invention is illustrated. FIG. 4 depicts a simplified side view of the apparatus 100 of FIG. 3, and shows how toner from the developing section 114 can be applied to the transfer medium 24, shown here as a belt, to generate a first calibration image product P1 and at least a portion of a second calibration image product P2'. The developer stations or toner stations 16, 18, 20 and 22 are shown as being optical photoconductors (OPCs), which each have as an intermediate transfer medium a rotating drum which transfers toner from a toner hopper (not shown) to the transfer belt 24. The toner section 114 can alternately be configured to apply toner directly to the transfer medium 28 from the toner hoppers. While the transfer medium is shown as a rotating belt, it can also comprise other configurations, such as a rotating drum. The scanning section 112 includes scanning lasers and optical components (not shown) to allow the lasers to selectively expose the various OPCs in accordance with the calibration product generation algorithm 136 of FIG. 3. The first calibration image product P1 is comprised of toners T1, T2, T3 and T4, which are deposited by respective toner stations 22, 20, 18 and 16. The second calibration image product P2 can be generated while the transfer medium 24 is moving the first calibration image product P1 towards the calibration sensor 28.

Returning briefly to FIG. 3, we see that the image producing device 100 of FIG. 3 can also be provided with a cleaning station 40, which is configured to remove toner from the transfer medium prior to the transfer medium returning to the developing section 112. An alternate location for the cleaning station is shown at 40', wherein the cleaning station is located proximate the developing section 114. In yet another embodiment, the cleaning station can be incorporated into one of more of the developer stations. The latter embodiment is shown in FIG. 3 wherein cleaning stations 117, 119, 121 and 123 are each associated with respective developer stations 116, 118, 120 and 122. The advantage of locating the cleaning station proximate to or within the developer section is that it allows more calibration images to be produced on the belt before they are removed. This in turn allows the calibration sensor to be located farther along the path of travel of the transfer medium than is depicted in FIG. 3.

Returning now to FIG. 4, the first calibration image product P1 can comprise the four toners, as described previously. The second calibration image product P2 can comprise modified depositions of the toners, indicated as T'4, T'3 and T'2. For example, these depositions can be half-tones of the toners. In FIG. 4, the second calibration image is depicted as not completely generated, and is shown as partial calibration image product P2' (as opposed to the completed product, P2). The portion of P2' indicated as T'1' has not been generated yet, but is shown in outline view to aid in understanding how the completed image P2 will appear on the transfer medium. Once P2 is complete, there will preferably be a separation "S" between the first calibration product P1 and the second calibration product P2. This separation will aid the imaging device calibration sensor and algorithms in detecting when the first calibration image product ends and the second calibration image product begins.

FIG. 4 reveals that, when the calibration image products are generated as shown and in accordance with the present invention, at least a portion of the second calibration image product P2' resides on the transfer medium while at least a portion of the calibration image product P1 is simultaneously resident on the transfer medium. Further, as depicted, the second calibration image product P2 is being generated while the first calibration image product P1 is being moved towards the calibration sensor 28, and in particular, while the first calibration image product P1 is being detected by the calibration sensor 28.

Figure 5:
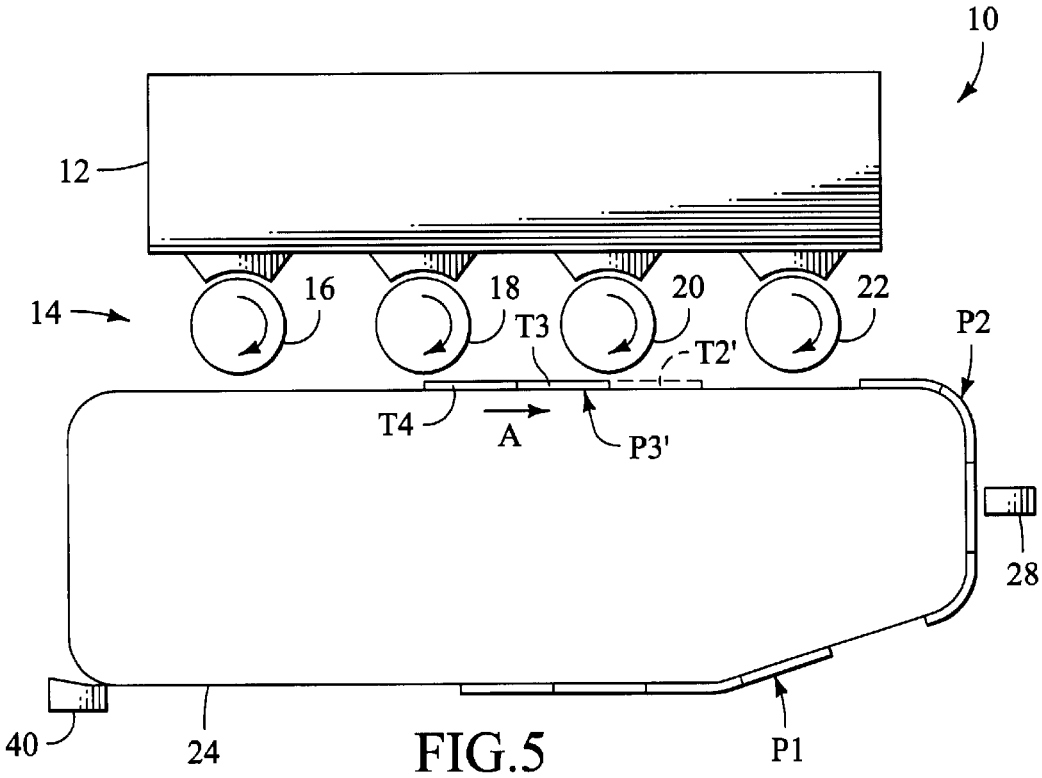
FIG. 5 is a schematic diagram depicting another method for generating a plurality of calibration image products in accordance with the present invention using the imaging device of FIG. 3.

Turning now to FIG. 5, the image producing device 100 of FIG. 3 is again depicted in simplified form. However, as shown in FIG. 5, the transfer medium now contains complete calibration image products P1 and P2, and partial calibration image product P3'. Partial calibration image product P3' is depicted as comprising toners T4 and T3. Toner outline T2' is shown to indicate how toner T2 will de deposited by toner station 20. Observation of FIG. 4 reveals the following: (1) at least two complete calibration image products P1 and P2 are simultaneously resident on the transfer medium 24; (2) at least a portion of a third calibration image product P3' is being generated while the second calibration product P2 is being detected by the calibration sensor 28; and (3) at least a portion of a third calibration image product P3' is being generated after the first calibration product P1 has been detected by the calibration sensor 28.

The embodiment depicted in FIG. 5 allows the third calibration image product P3 to be selected based on the results of the calibration sensor scan of the first calibration image product P1, and while the second image product P2 is being sensed by the calibration sensor. That is, after calibration product P1 has been scanned by the calibration sensor 28, the calibration information produced by the sensor can be transmitted to the RAM 138 of FIG. 3. The processor 30 can then process the calibration information from the first calibration image product P1 and determine what, if any, calibration of the image producing device 100 is necessary to bring the device into calibration based on the differences between the first calibration image and the first calibration image product. Once the adjustments have been made, a the first calibration image can then be generated again to determine if the calibration has been properly affected. In this instance the "third" calibration image product P3 is a representation of the first calibration image. The first calibration image product P1 and the third calibration image product P3 will differ in that the latter product has been generated based on calibration information from the first calibration product. In this manner a much faster calibration of the image producing device can be affected. However, in order to implement this embodiment, sufficient RAM 138 should be provided such the RAM can store all of the calibration information from the first calibration image product P1, as well as any information based on detecting the second calibration image product P2 with the sensor 28 prior to initializing generation of the third calibration image product P3.

A completed calibration image product can consist of a plurality of toners deposited adjacent to one another on the transfer medium. Alternately, or in addition to being placed adjacent to one another, the toners can be separated from one another, or overlapped with one another to form other colors. Furthermore, the calibration image can require the toners to be a dithered pattern of a primary toner, with either no toner applied between the dithered pixels or with alternate toner or toners applied to the spaces between the dithered pixels. In this way half-tone colors and images can be generated. Still further, the calibration image can comprise predefined geometric shapes to determine whether the image producing device accurately images such shapes. For example, if part of the calibration image comprises a circle yet the calibration image product is an ellipse, this suggests the speed of the transfer belt is not synchronized with the speed of the scanning lasers, and one or both of them can be adjusted to cause the image producing device to properly image a circle.

Figure 6:
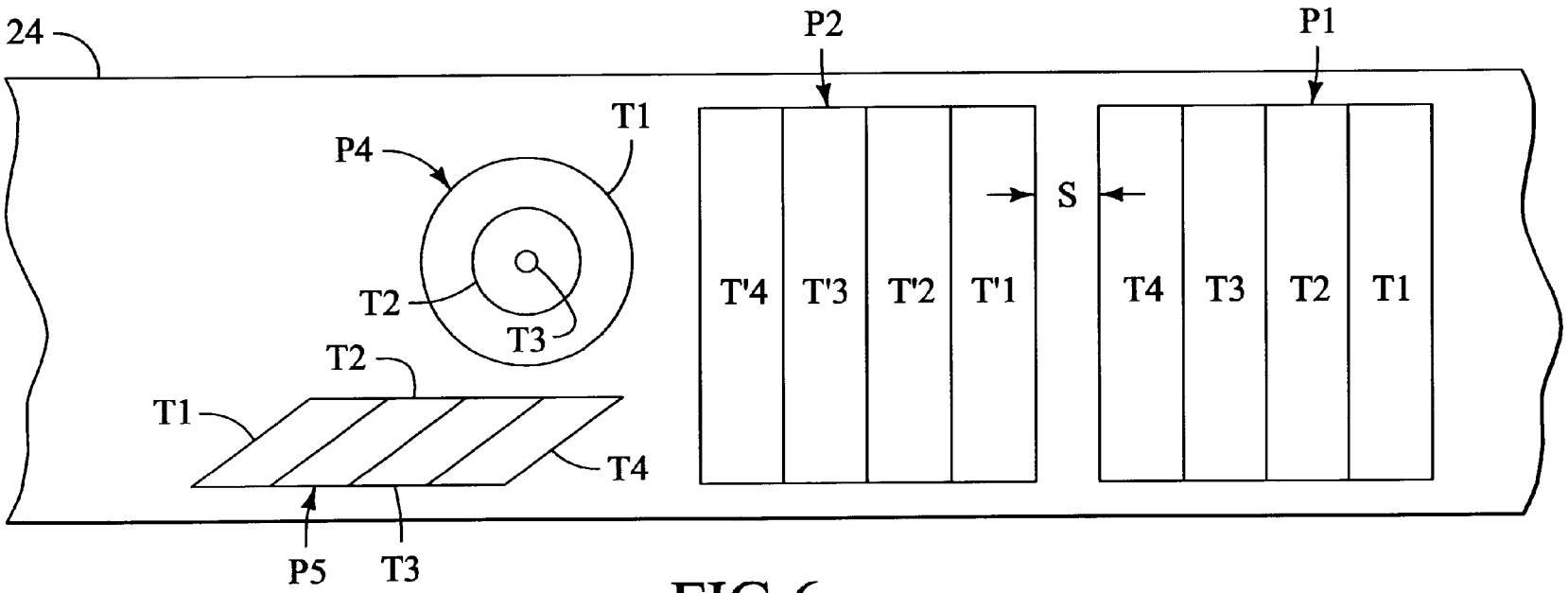
FIG. 6 is a plan view of different calibration image products generated on a transfer medium using the methods of the present invention.

With this in mind, FIG. 6 depicts how various calibration image products can be generated on a transfer medium using the methods of the present invention. FIG. 6 depicts a plan view of a transfer medium, belt 24 of FIG. 3, containing four calibration image products P1, P2, P4 and P5. As depicted, the transfer belt 24 of FIG. 3 has basically been "cut and unfolded", and the portion containing the calibration products is shown. Calibration image product P1 is shown as in FIG. 4, comprising toners T1, T2, T3 and T4. Calibration image product P2 is shown comprising toners T'1, T'2, T'3 and T'4, which can be half-tones of respective toners T1, T2, T3 and T4. Calibration image product P4 is depicted as a series of concentric circles comprising toners T1, T2 and T3. Calibration image P5 is depicted as a series of diagonal stripes of toners T1, T2, T3 and T4. It should be appreciated that each of these calibration products can be used to check for different calibration characteristics.

Preferably, when multiple calibration images are generated on a single pass of the transfer medium past the developer section, the calibration products are distinguished from one another such that the calibration sensor and calibration algorithm can determine when the detecting of one calibration product is terminated, and another begun. One method for distinguishing one calibration product from another is shown in FIG. 6, wherein calibration image products P1 and P2 are separated by a separator "S" , indicated here as a blank space on the transfer medium having no toner. In this instance, when the calibration sensor detects the absence of toner, the calibration algorithm can be configured to indicate that sensing of the then-current calibration product is terminated, and can then begin processing the calibration information. Alternately, the separator can comprise a toner of a designated color, such as a black band of toner. Further, the calibration images and/or the calibration product generation algorithm (134 and 136 of FIG. 3, respectively) can be configured to generate a bar code or the like between calibration image products which can be detected by the calibration sensor. Such a bar code can contain information to be used by the processor in performing the calibration product generation process and the calibration process itself.

Another method to distinguish one calibration image product from another is to predefine the size, and in particular the length, of the calibration image. The resulting calibration image product will take a certain period of time to pass by the calibration sensor, the period of time being determined by dividing the length of the calibration image by the rate of travel of the transfer medium. The calibration algorithm can then be configured to collect calibration information from the calibration sensor during this period of time. In like manner, a separator of a predetermined length, and therefore time, can be inserted between calibration image products, and the calibration algorithm can be configured to resume collecting calibration information following the passing of the separator.

Further, a combination of the above described methods can be used such that data collection of the calibration information commences when the leading edge of a calibration image product is detected, and data collection for that calibration products ends after a predefined period of time. Still further, the above described methods can be used in parallel as a check. For example, a calibration image can be configured such that the resulting calibration product is intended to pass by the calibration sensor during a predetermined period of time. However, if the calibration sensor does not detect the trailing edge of the calibration product at the predetermined time, this suggests that the rate of travel of the transfer medium needs to be adjusted.

Preferably, the calibration images are configured and selected such than an optimum number of calibration image products, or portions thereof, are simultaneously resident on the transfer medium. The optimization can be a function of at least the following, either separately or in various combinations: (1) the location of the calibration sensor with respect to the developer section; (2) the location of the cleaning station with respect to the developer section; (3) the location of the calibration sensor with respect to the cleaning station; (4) the size of the random access memory used to store calibration information received from the sensor; (5) the rate at which the processor can process calibration information, perform calibration functions, and cause calibration image products to be generated; (6) the number and type of criteria to which the image producing device is to be calibrated; and (7) the ability of the calibration algorithm to correctly calibrate the image producing device for a given characteristic using a single calibration image product.

Figure 2:
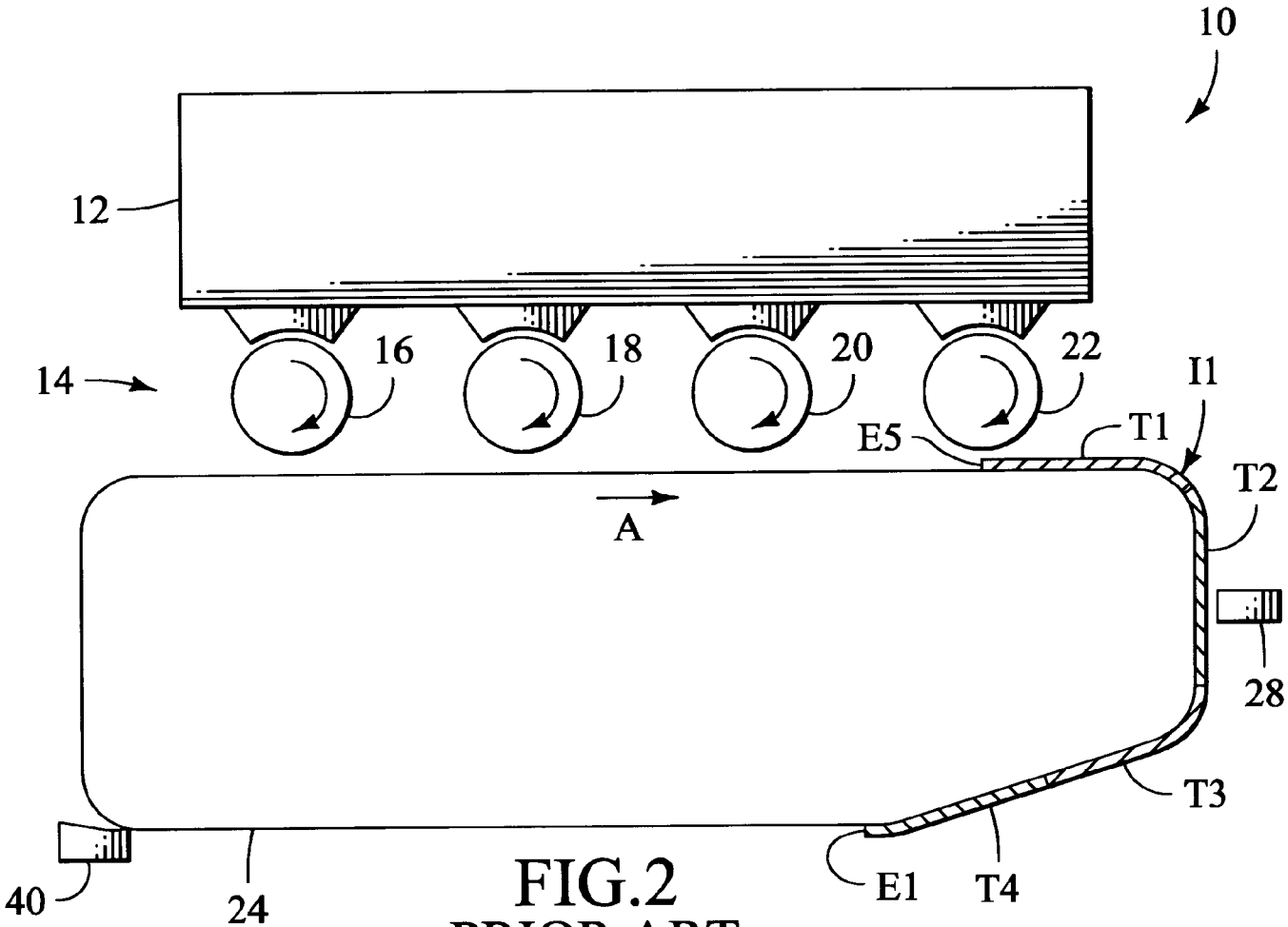
FIG.2 PRIOR ART
FIG. 2 is a schematic diagram depicting the prior art method for generating a calibration product image using the imaging device of FIG. 1.
Figure 7:
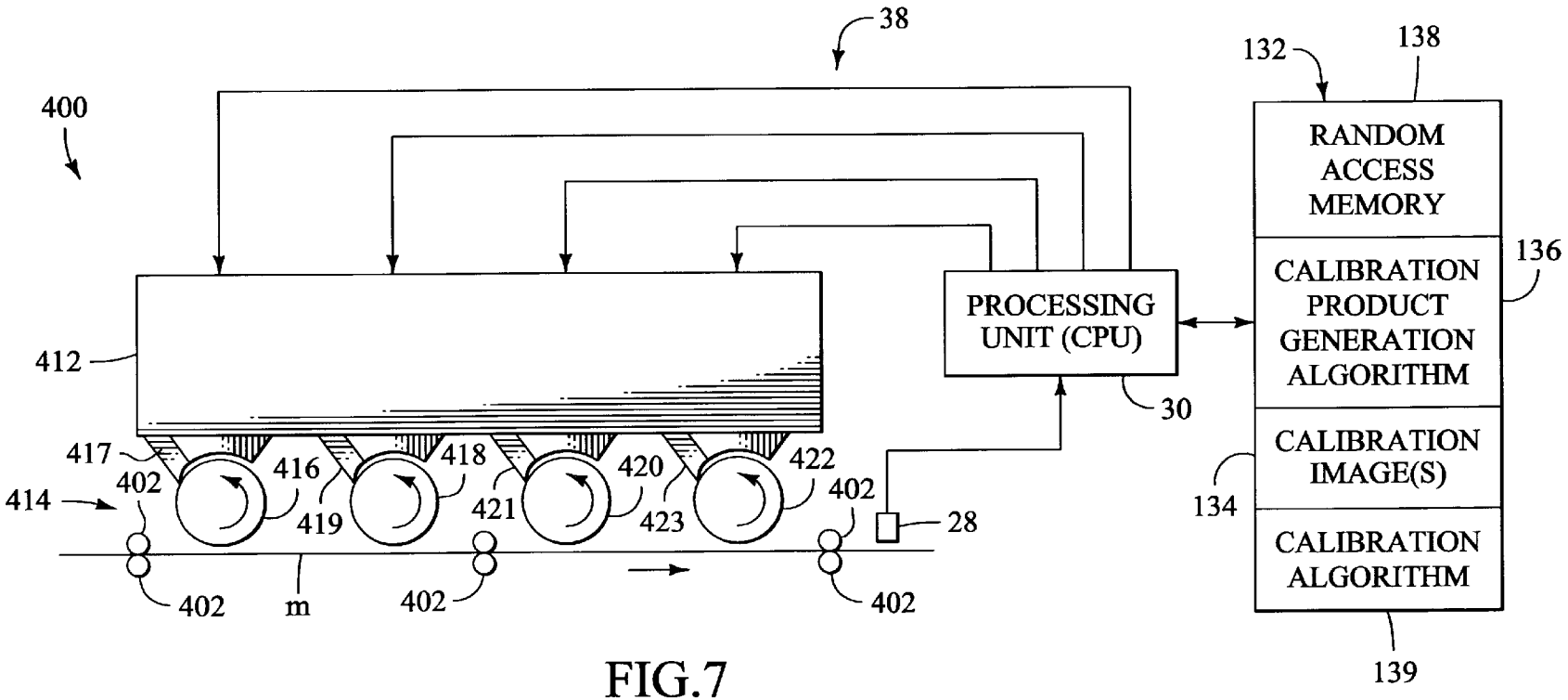
FIG. 7 is a is a side elevation schematic of an alternate imaging device having a calibration image product generating algorithm in accordance with the present invention.

With reference to FIG. 7, an alternative embodiment of an imaging apparatus 400 which can implement the calibration product generation methods of the present invention is depicted. The imaging apparatus 400 is similar to the apparatus 100 of FIG. 2, except that the transfer medium 24 of FIG. 2 is eliminated, along with the accompanying rollers 26 and cleaning station 40, 40'. In place of the transfer medium 24 of FIG. 2, a sheet of final image medium "m", such as a piece of paper, is used. In the imaging apparatus 400 of FIG. 7 the final image medium "m", which is supported by rollers 402, is passed directly by the toner stations 416, 418, 420 and 422. Toner from the toner stations can then be deposited directly onto the final image medium "m" in accordance with the methods disclosed above. The final image medium "m" also passes by the calibration sensor 28 after passing the last toner station 422. In this manner, the calibration sensor 28 can begin detecting the calibration image product on the final image medium "m" while toner is still being applied by the toner stations 416, 418, 420 and/or 422 onto the image medium "m".

While the above invention has been described in language more or less specific as to structural and methodical features, it is to be understood, however, that the invention is not limited to the specific features shown and described, since the means herein disclosed comprise preferred forms of putting invention into effect. The invention is, therefore, claimed in any of its forms or modifications within the proper scope of the appended claims appropriately interpreted in accordance with the doctrine of equivalents.

What is claimed is:

1. A method for generating calibration image products for an image producing device, the image producing device having a transfer medium and a developer section configured to deposit toner onto the transfer medium to thereby generate the calibration image products, comprising:

depositing toner onto the transfer medium using the developer section to produce a first calibration image product; and depositing toner onto the transfer medium using the developer section to produce at least a portion of a second calibration image product prior to removing the entire first calibration image product from the transfer medium;

and wherein at least a portion of the first calibration image product is sensed by at least one calibration sensor simultaneously with the deposition of the toner to produce the at least a portion of the second calibration image product.

2. A method for generating calibration image products for an image producing device, the image producing device having a transfer medium and a developer section configured to deposit toner onto the transfer medium to thereby generate the calibration image products, comprising:

depositing toner onto the transfer medium using the developer section to produce a first calibration image product;

depositing toner onto the transfer medium using the developer section to produce at least a portion of a second calibration image product prior to removing the entire first calibration image product from the transfer medium;

providing at least one calibration sensor configured to sense the calibration image products and generate calibration information therefrom; and using calibration information relating to the first calibration image product to selectively product the second calibration image product.

3. A method for calibrating an image producing device, the image producing device having a transfer medium and a developer section configured to deposit toner onto the transfer medium to thereby generate calibration image products, the image producing device further having a calibration sensor to detect the calibration image products, the method comprising:

depositing toner onto the transfer medium using the developer section to produce a first calibration image product;

moving the transfer medium to cause at least a portion of the first calibration image product to move past the calibration sensor; and depositing toner onto the transfer medium using the developer section to produce at least a portion of a second calibration image product while continuing to move the first calibration image product past the calibration sensor.

4. The method of claim 3, and further comprising storing calibration information produced by the calibration sensor for the first calibration image product in a computer readable memory, and using the stored calibration information for the first calibration image product to calibrate the image producing device.

5. The method of claim 3, and wherein the toner deposited by the developer section comprises a plurality of toners of different colors.

6. The method of claim 3, and further comprising creating a separator between the first calibration image product and the second calibration image product, the separator being distinguishable by the calibration sensor.

7. The method of claim 3, and further comprising continuing to depositing toner onto the transfer medium using the developer section to complete the second calibration image product; and depositing toner onto the transfer medium using the developer section to produce at least a portion of a third calibration image, such that the first, the second, and the at least a portion of the third calibration images are simultaneously resident on the transfer medium.

8. An image producing apparatus comprising:

a scanning section;

a developer section;

a transfer medium;

a calibration image product generator;

a processor in signal communication with the scanning section, and computer readable memory accessible by the processor, and wherein the calibration image generator is configured to generate a first calibration image product by causing the developer section to selectively deposit toner onto the transfer medium at a first location, the calibration image generator being further configured to generate at least a portion of a second calibration image product by causing the developer section to selectively deposit toner onto the transfer medium at a second location; and the calibration image product generator comprises a series of computer executable steps stored in the computer readable memory, the series of computer executable steps being configured to direct the processor to cause the scanning section to generate the first and second calibration image products via the developer section.

9. The image producing apparatus of claim 8, and wherein the calibration image product generator further comprises first and second digitized calibration images to be respectively reproduced as the first and second calibration image products, and wherein the digitized calibration images are sized to allow the first calibration image product and at least a portion of the second calibration image product to reside on the transfer medium simultaneously.

10. The image producing apparatus of claim 9, and wherein the calibration image product generator is further configured to insert a separator on the transfer medium between the first and second calibration image products.

11. The image producing apparatus of claim 8, and further comprising a calibration sensor configured to detect calibration image products on the transfer medium and generate calibration information in response thereto, the calibration sensor being in signal communication with the computer readable memory, the computer readable memory being configured to allow calibration information from the first calibration image product and at least a portion of calibration information from the second calibration image product to be stored simultaneously in the computer readable memory.

12. The image producing apparatus of claim 8, and further comprising a cleaning station located proximate the transfer medium and configured to remove toner from the transfer medium, the cleaning station being further located proximate the developer section.

13. The image producing apparatus of claim 8, and further comprising a cleaning station located within the developer section and proximate the transfer medium, the cleaning station being and configured to remove toner from the transfer medium.

14. A method for calibrating an image producing device, the image producing device having a developer section configured to deposit toner onto a final image medium to thereby generate calibration image products, the image producing device further having a calibration sensor to detect the calibration image products, the method comprising:

depositing toner onto final image medium using the developer section to produce a first calibration image product;

moving the final image medium to cause at least a portion of the first calibration image product to move past the calibration sensor; and depositing toner onto the final image medium using the developer section to produce at least a portion of a second calibration image product while continuing to move the first calibration image product past the calibration sensor.

15. The method of claim 14, and further comprising detecting the fist calibration image product using the calibration sensor to generate calibration information, and using the calibration information to generate the second calibration image product.

16. The method of claim 15, and wherein the first and second calibration image products are generated using a single calibration image algorithm.

17. The method of claim 14, and wherein the first and second calibration image products are generated using different calibration image algorithms.

* * * * *